US006529167B2

(12) United States Patent
Webb

(10) Patent No.: US 6,529,167 B2
(45) Date of Patent: Mar. 4, 2003

(54) ANTENNA WITH INTEGRATED FEED AND SHAPED REFLECTOR

(75) Inventor: David B. Webb, Dallas, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/999,012

(22) Filed: Oct. 31, 2001

(65) Prior Publication Data

US 2002/0080086 A1 Jun. 27, 2002

Related U.S. Application Data

(60) Provisional application No. 60/244,938, filed on Nov. 1, 2000.

(51) Int. Cl.[7] ..... H01Q 1/38; H01Q 21/00

(52) U.S. Cl. ..... 343/700 MS; 343/795; 343/853

(58) Field of Search ..... 343/700 MS, 795, 343/810, 816, 820, 821, 822, 853, 850; H01Q 1/38, 9/28, 21/00

(56) References Cited

U.S. PATENT DOCUMENTS 5,596,336 A * 1/1997 Liu ..... 343/770
5,633,613 A * 5/1997 MacDonald ..... 343/700 MS
5,867,132 A 2/1999 Blasing et al. ..... 343/890
5,943,023 A 8/1999 Sanford ..... 343/772
5,959,590 A 9/1999 Sanford et al. ..... 343/781 CA
5,973,652 A 10/1999 Sanford et al. ..... 343/781 P
6,043,787 A 3/2000 Sanford et al. ..... 343/772

OTHER PUBLICATIONS

Bjorn Lindmark, Peter Slattman and Anders Ahfeldt, *Genetic Algorithm Optimization of Cylindral Reflectors for Aperture–Coupled Patch Elements,* IEEE, 1999.

Peter Slattman and Bjorn Lindmark, *Moment Method Analysis of an Aperture Coupled Patch Antenna in a Cylindrical PEC Structure with Arbitrary Cross Section,* 2000 AP Symposium; Salt Lake City.

* cited by examiner

*Primary Examiner*—Hoanganh Le
(74) *Attorney, Agent, or Firm*—Wood, Herron & Evans, L.L.P.

(57) ABSTRACT

An integrated feed system for an antenna includes a circuit board, a feed network formed on the circuit board, and a plurality of feed elements electrically coupled with the feed network and projecting outwardly therefrom. The circuit board has one or more projecting edge parts for mounting the feed elements. An antenna having one or more reflector elements utilizes the integrated antenna feed system. A corresponding method for the feed system and the antenna is also provided.

49 Claims, 12 Drawing Sheets

ANTENNA WITH INTEGRATED FEED AND SHAPED REFLECTOR

CROSS REFERENCE TO RELATED APPLICATIONS

This application claims the benefit of the priority date of U.S. Provisional application, Serial No. 60/244,938, filed Nov. 1, 2000, under the same title. The disclosure of the provisional application is incorporated herein by reference in its entirety.

FIELD OF THE INVENTION

This invention is directed generally to antenna, and more particularly to a novel feed network integrated with an array of antenna elements and a shaped reflector.

BACKGROUND OF THE INVENTION

Local multipoint distribution service (LMDS) is a broadband wireless point-to-multipoint communication system that can be used to provide digital two-way voice, data, Internet, and video services. In such a definition, "local" denotes that propagation characteristics of signals in this system limit the potential coverage area to that of a single cell site. For example, field trials conducted in metropolitan centers limit the range of transmitters in these systems to approximately five miles. "Multipoint" indicates that base station signals are transmitted in a point-to-multipoint or broadcast method; whereas, the wireless return path, from subscriber to the base station, is a point-to-point transmission. "Distribution" refers to the distribution of signals, which may consist of simultaneous voice, data, Internet, and video traffic. "Service" implies the subscriber nature of the relationship between the operator and the customer or the services offered through an LMDS network that are entirely dependent on the operator's choice of business.

For LMDS, or other similar point-to-multipoint applications, base station antennas are required to deliver services over one or more sectors within a cell site. To meet this requirement, antennas should have reasonably high gain characteristics and meet a specified azimuth beamwidth to provide the desired sector coverage. Furthermore, it is desirable to provide a relatively rugged and reliable antenna structure since such systems are often deployed in an urban environment. Ideally, such an antenna structure should have relatively simple and few parts and be relatively easy and inexpensive to manufacture and to install and maintain in the field.

Therefore, a significant need exists in the art for an improved antenna that has desirable azimuth beamwidth characteristics that has relatively few and uncomplicated parts. It is also desirable that any such antenna be straightforward and inexpensive to manufacture and install and maintain. It is s till further desirable, that such an improved antenna has applicability within an LMDS system.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

Similar to FIG. 7.

Similar to FIG. 14.

Similar to FIG. 16.

DETAILED DESCRIPTION

To address the needs in the art, and in accordance with the present invention, a shaped reflector antenna, excited by a linear array of dipole elements or dipoles, is disclosed to address the above-described need in LMDS systems, such as systems operating on the 10.15–10.65 GHz LMDS band. In one embodiment of the invention, the antenna and associated components and housing is roughly the size and shape of a "pizza box," (e.g., a rectilinear "box" on the order of one foot square with thickness of on the order of a few inches) and can be readily modified to cover any desired sector beamwidth (e.g., 30 to 90 degrees), with a narrow, shaped elevation pattern.

It will be appreciated that other modifications could be made to this antenna for use in other frequency bands and for other purposes and services without departing from the spirit of the invention. Similarly, various different modulation schemes and/or other types of services could also be provided in accordance with the disclosed embodiment without departing from the spirit of the invention.

Figure 1:
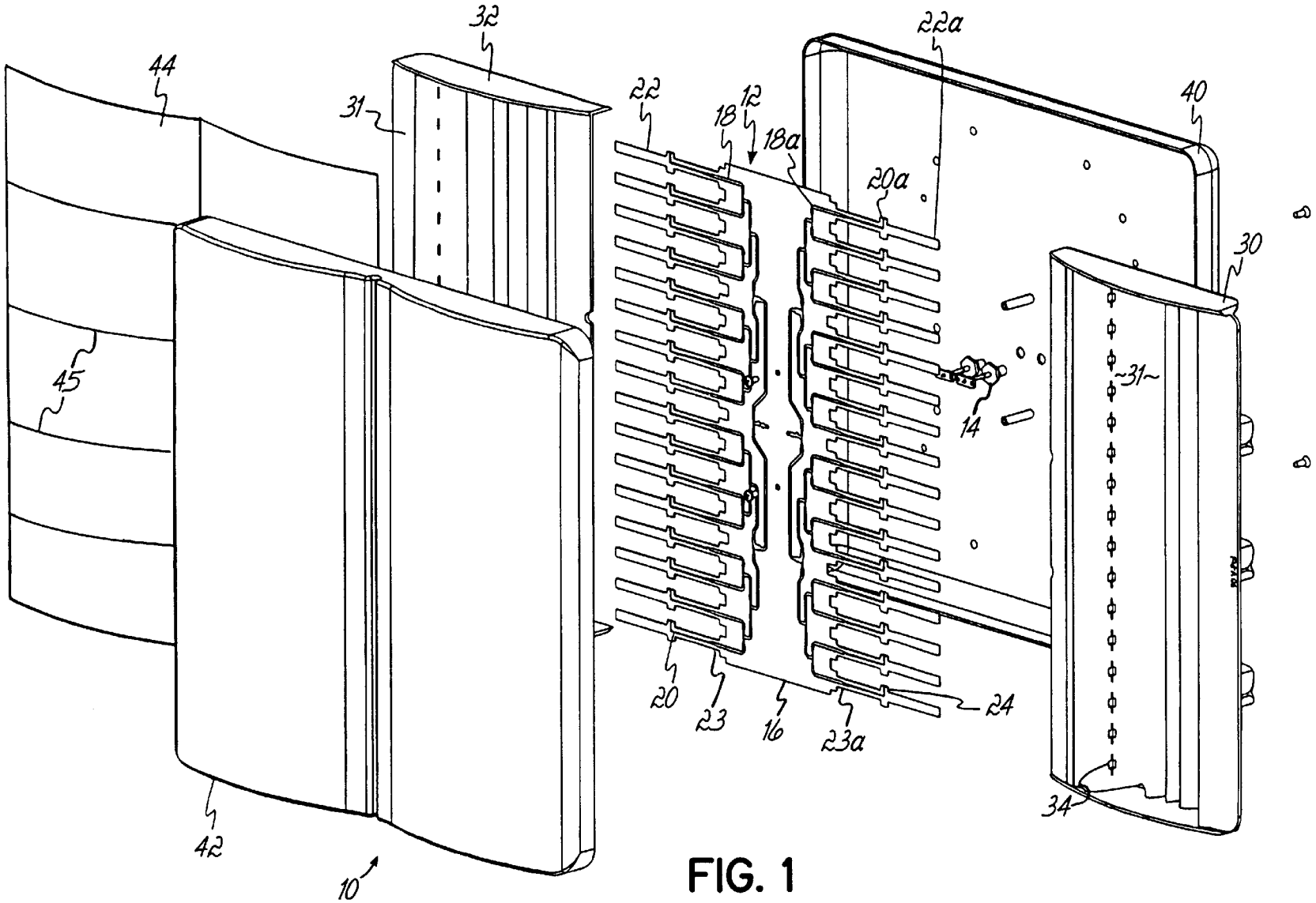
FIG. 1 is an exploded view of a vertically polarized antenna in accordance with one embodiment of the present invention.

Referring now more particularly to the drawings, FIG. 1 shows an exploded view of a vertically polarized antenna embodiment referenced above employing an integrated feed system in accordance with one embodiment of the present invention. The antenna structure is designated generally by reference numeral 10. The integrated feed system or network is designated generally by reference numeral 12. Connectivity to the feed system 12 is provided via coaxial connectors 14; however, various other connectors may be used without departing from the spirit of the invention. The feed system 12 includes a flat substantially planar circuit board 16 that may be a sheet of dielectric circuit board material. One suitable such board material is on the order of 0.030 inches thick. Other thicknesses may be used without departing from the invention. However, such a thickness has been found to be suitable for applications in the 10.15–10.65 GHz LMDS band. The board 16 is shaped and formed for the purposes of the invention as shown in FIG. 1.

Figure 2:
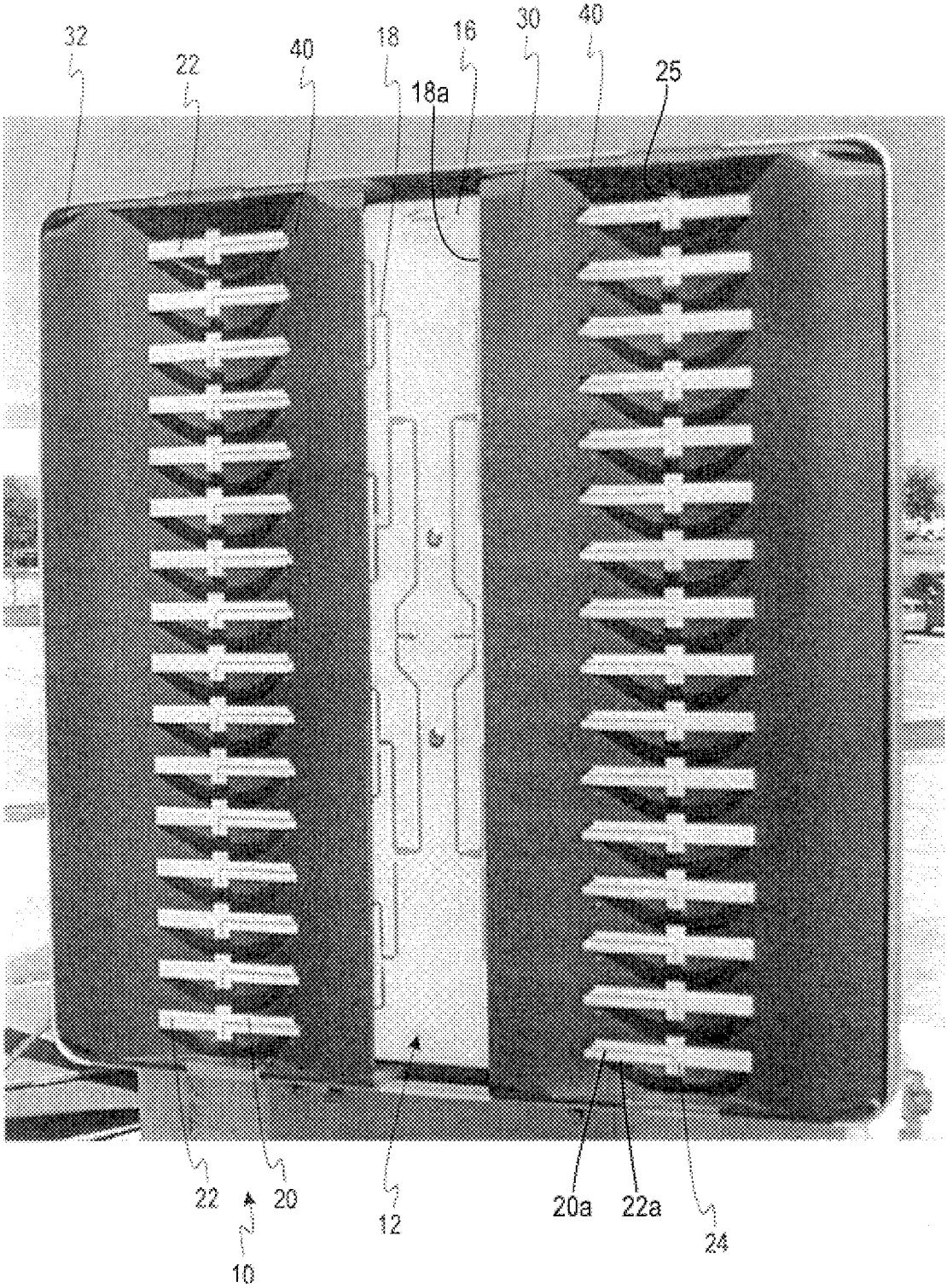
FIG. 2 is a photograph of another embodiment of the present invention for installation; such as in an urban environment, with the radome cover and polarizing sheet removed.
Figure 4:
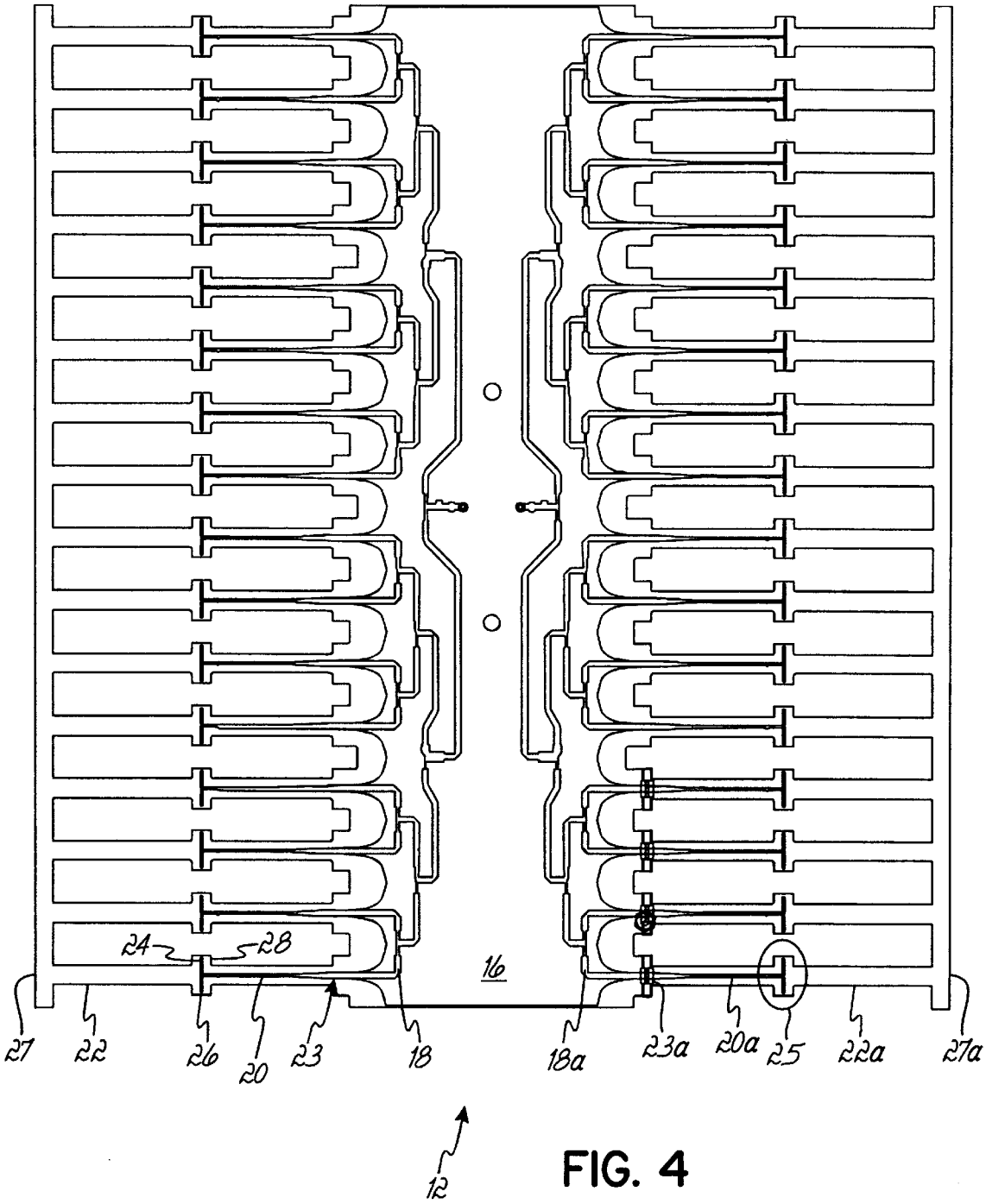
FIG. 4 is an enlarged plan view of one embodiment of a circuit board and feed network for an antenna.
Figure 5:
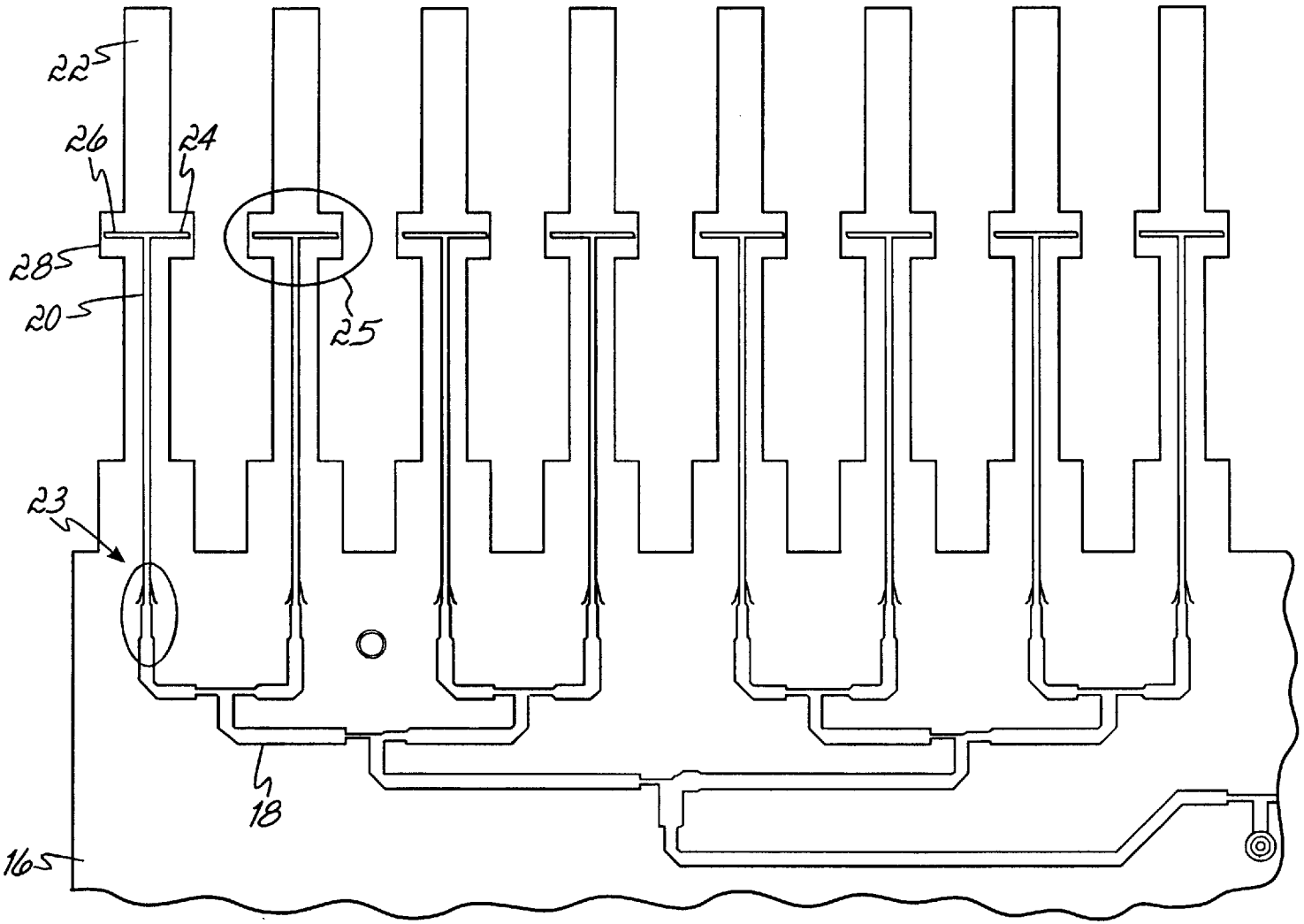
FIG. 5 is an enlarged elevation of a portion of the circuit board and feed network of the embodiment of FIG. 4.

Etched or otherwise formed or deposited on the front surface of the circuit board 16 and visible in FIG. 1, is an electrically conductive microstrip pattern that forms a feed network 18. The pattern for the feed network 18 may be deposited in copper or other suitable conductive material by any suitable process. Referring to FIGS. 2, 4, and 5, the microstrip feed network 18, 18*a* feeds or is electrically coupled to a plurality of feed or radiating elements 20. In the illustrated embodiment those radiating elements 20 have portions that are configured as dipole elements. The feed network 18 and elements 20 are duplicated on the other half of board 16 as elements 18*a*, 20*a*. In FIGS. 1, 2 and 4, the dipole elements 20, 20*a* are deposited on projecting fingers 22, 22*a* of the circuit board 16 which project outwardly from sides of board 16 and from the corresponding feed networks 18, 18*a*. In the embodiment of FIG. 1, the feed networks 18, 18*a*, and elements 20, 20*a* are shown positioned on both lateral edges of the circuit board 16; however, the elements 18, 20 may also only be on one side. These projecting fingers 22, 22*a* are routed, cut or otherwise formed in the same sheet of dielectric material which forms the rest of circuit board 16. In accordance with conventional practice, baluns or balun regions 23, 23*a* are formed on the circuit board 16 in the area in which the feed networks 18, 18*a* join the projecting feed or radiating elements 20, 20*a*, which in the embodiment of FIGS. 1, 2, and 4–6 are dipole elements or dipoles. Like the feed networks 18, 18*a*, the dipole elements 20, 20*a* and baluns 23, 23*a* are formed by a conductive microstrip pattern.

Figure 6:
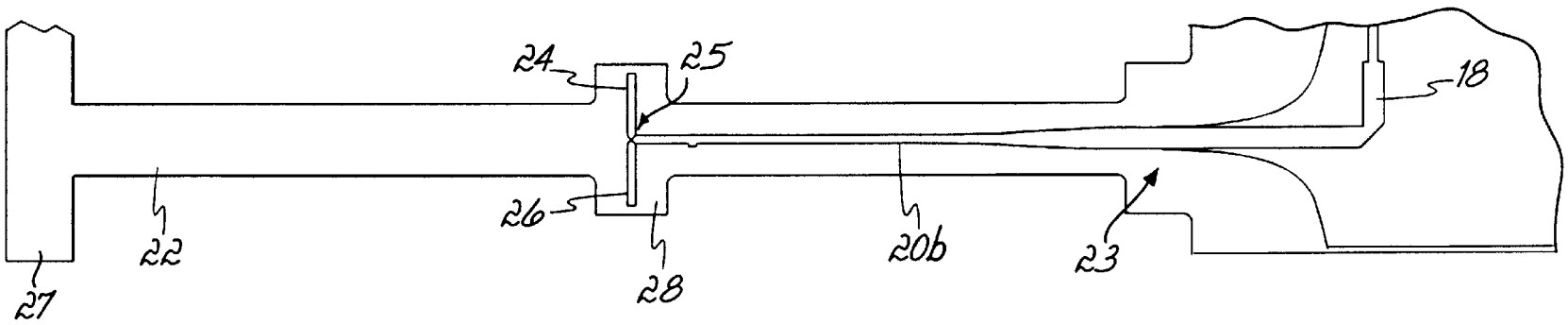
FIG. 6 is a fragmentary view, similar to FIG. 4, showing an alternative embodiment of a portion of the feed network for the antenna.

In the illustrated embodiment, corresponding feed networks and feed elements (similar to the feed networks 18, 18*a* and feed elements 20, 20*a*) are formed on the opposite or back surface of the circuit board 16, which is not visible in FIG. 1. On one surface of the circuit board 16 the dipole elements defining the feed elements 20, 20*a* project in one direction on fingers 22, 22*a*, for example, as indicated by the reference numeral 24. Referring to FIGS. 4–6, the dipole elements 20, 20*a*, on one surface of the circuit board 16 have a portion 24 that extends generally upwardly with the board oriented as shown. On the opposite surface of the circuit board 16, the elements 20, 20*a* include a portion 26 which extends generally downwardly in an opposite direction to portion 24. The microstrip patterns forming the feed networks 18, 18*a* and the feed elements 20, 20*a* align with each other, as do the portions 24, 26, which are shown linearly aligned in FIGS. 4–6. FIGS. 4–6 are essentially illustrated as if the circuit board 16 is clear, so that both portions 24, 26 are visible and shown extending in opposite directions. FIG. 1 shows one surface with only portions 24 illustrated. The corresponding portions 24, 26 deposited on the front and back sides of the circuit board 16 collectively define a dipole element, referred to as dipole 25. In order to accommodate the respective dipole elements 25, the finger 22 is somewhat wider in regions 28, as shown in FIGS. 4–6, where these elements are deposited or otherwise formed. Thus, the circuit board 16, feed networks 18, 18*a*, and dipole elements 20, 20*a* with dipole elements 25 together form an integrated antenna feed network that is a unitary structure and is relatively straightforward and inexpensive to manufacture.

A second aspect of the invention involves reflector elements 30, 32 used in conjunction with the feed networks 18, 18*a* and elements 20, 20*a*. In the embodiment of FIG. 1, dual reflectors elements or panels 30, 32 are used. Referring to FIG. 4, the fingers 22, 22*a* bearing dipole elements 25 will overlay the reflector elements 30, 32, shown in FIGS. 1–2. Referring to FIG. 4, outermost edge strips 27, 27*a* of circuit board 16 are cut away or otherwise removed prior to assembly of the feed network 12 with the reflector elements 30, 32. This allows the fingers 22, 22*a* to move through slots in the reflector elements 30, 32.

Figure 3:
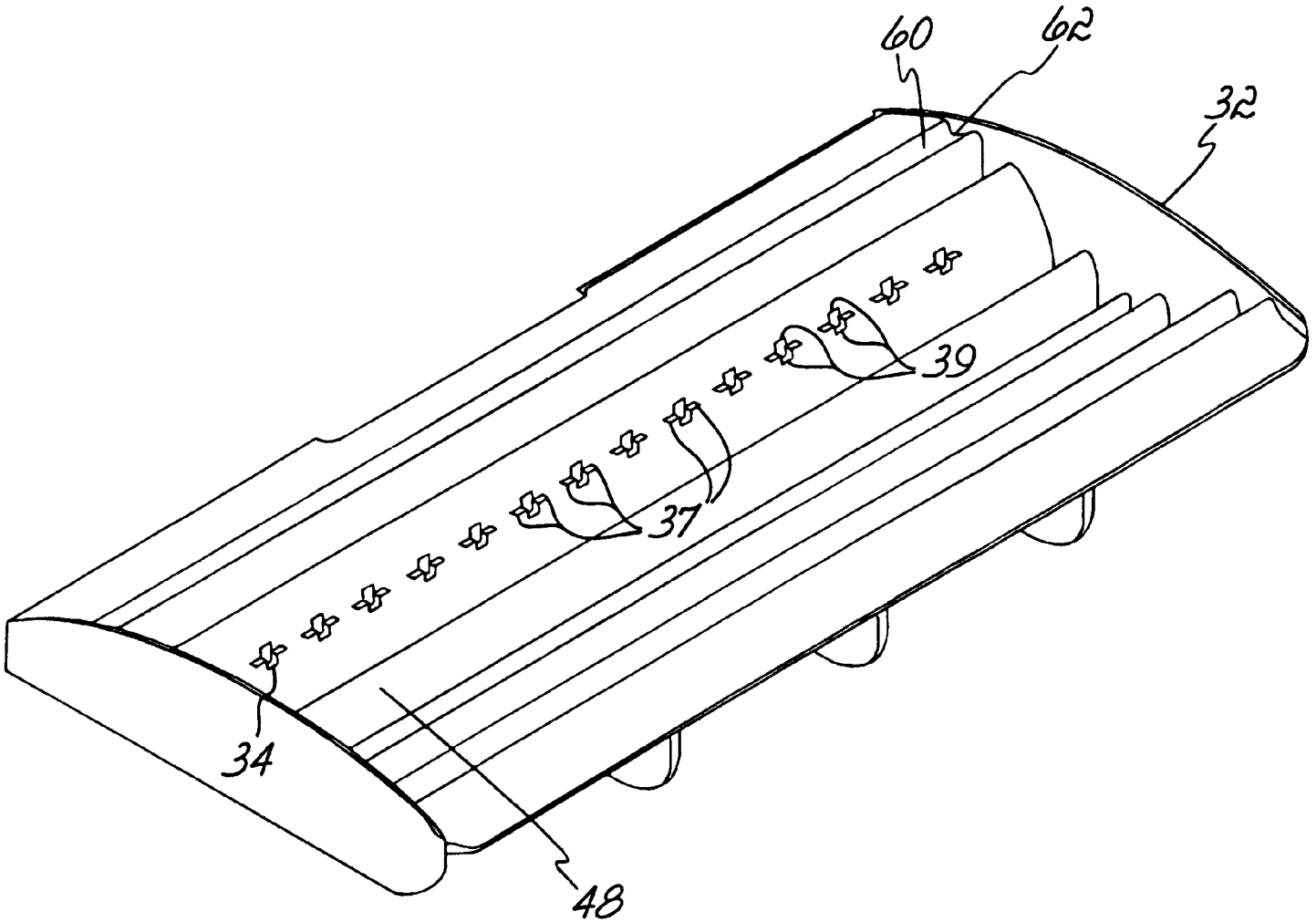
FIG. 3 is an enlarged perspective view of a shaped reflector element of an antenna in accordance with one embodiment of the invention.

Referring once again to FIG. 1, in order to conveniently position fingers 22, 22*a* and dipole elements 25 relative to the reflector elements 30, 32 in such a manner as to suspend the dipole elements 25 at a desired position relative to the reflector element surfaces 31 and overlaying the reflector elements 30, 32, a number of through slots or apertures 34, 36 are formed in the reflectors. In this embodiment, the apertures 34 through the reflector elements are generally cross or "plus sign" shaped as shown in FIGS. 1–3; however, the apertures 34 may be any shape which allows the fingers 22, 22*a* to pass through the reflector elements 30,32 without the feed networks 18, 18*a* contacting the reflectors when assembled. As seen in FIG. 3, the vertical arm or portion 37 of each of these apertures 34 is relatively narrow, and preferably just wide enough to allow passage of the thin material of the fingers 22*a*, 22 therethrough, such as 0.030 inch thick fingers from a circuit board 16. The length of each vertical aperture portion 37 is also sufficient to allow the circuit board portion 28 with the dipole elements 25 to pass therethrough. The horizontal arm or portion 39 of each these apertures 34 are somewhat wider. The wider width of aperture portions 39 is in order to prevent or minimize interaction between the metal surfaces of the reflector elements 30, 32 and the feed networks 18, 18*a* and dipole elements 25 that are deposited on both sides of the fingers 22, 22*a*.

As shown in FIGS. 1 and 3, the outer end of fingers 22, 22*a* are supported by additional through apertures 36 in the outer edges of reflector elements 30, 32. The elongated fingers are inserted into the apertures 36 to provide additional support. However, these additional apertures 36 may be omitted without departing from the scope of the invention. In this case, the elongated portion of the fingers 22, 22*a* past the dipole elements 25 may be trimmed. In FIG. 3, the apertures are shown in phantom in a portion of the shaped reflector 32.

FIG. 1 also illustrates a radome including a metallic back cover 40 and a radome cover 42. A sheet of polarizing material 44 may be optionally mounted inside the radome cover 42. In the embodiment illustrated in FIG. 1, the polarizing sheet 44 is configured to reduce the cross-polarized antenna response. However, it will be appreciated that by rotating the dipoles 90 degrees and reconfiguring the polarizing sheet, and as will be shown in conjunction with the discussion of FIG. 9, horizontal polarization is possible without departing from the scope of the invention.

It will also be appreciated that the embodiments illustrated in conjunction with this disclosure are for implementations requiring two antennas similarly polarized, within a single housing. This is for applications that require redundancy. However, if both horizontal and vertical polarizations were desired, the two antennas could be configured to so as to provide both horizontal and vertical polarization within a single antenna structure according to principles of the invention. For example, one-half of the antenna structure shown in FIG. 1 may have components configured for one polarization and the other half of the antenna structure might provide the other polarization. Similarly, if only one antenna were desired, the structures of the embodiments illustrated herein could be divided in half, corresponding to substantially one-half of the structure of FIG. 1 along an imaginary vertical centerline.

Referring to FIG. 2, a photograph of an embodiment of an antenna consistent with the present invention is shown with the radome cover 42 and the polarizing sheet 44 removed. As depicted, FIG. 2 shows how the elements of the antenna appear when the antenna structure is assembled. One particular aspect of the described embodiment is the feed method, which integrates a feed network 18 with an array of dipole elements 25 on a single circuit board 16. The dipole elements 25, residing on fingers 22, 22*a* routed or otherwise formed on the board edges slide through apertures 34, 36 provided in the sides of the shaped reflectors 30, 32. The reflectors 30, 32, in the embodiment disclosed are plastic, and have a suitable metallic reflective coating, such as aluminum, copper or a reflective paint; however, other fabrication methods, such as sheet metal, will function in a similar manner.

Referring now to FIG. 3, an enlarged perspective view of the reflector element 32 of FIGS. 1 and 2 is shown. It should be appreciated that reflector element 32 may be used as either element 30 or 32 in the embodiment of FIGS. 1 and 2 by merely reversing the orientation of the panel, since the reflector elements thereof are symmetrically formed for either side of the antenna structures in antenna 10. That is, one of an identical pair of elements 30 may be rotated 180 degrees, while facing in the same direction to achieve the configuration of the panels 30, 32, as shown. This reduces the parts count when manufacturing an antenna in accordance with the aspects of the invention.

To utilize the antenna 10 disclosed herein for specific applications and frequency bands, the length of the dipoles may be selected to radiate at a desired frequency as will be known to a person of ordinary skill in the art. For example, for use in the 10 GHz LMDS signal band the dipole elements 25 may be 1.16 centimeters long. Similarly, the shape of the reflector elements 30, 32 may be selected so as to shape the radiation pattern of the dipole elements also as known to one of ordinary skill in the art. For example, the shape of the reflectors may be formed to obtain a desired azimuth beamwidth of 60 or 90 degrees.

Figure 7:
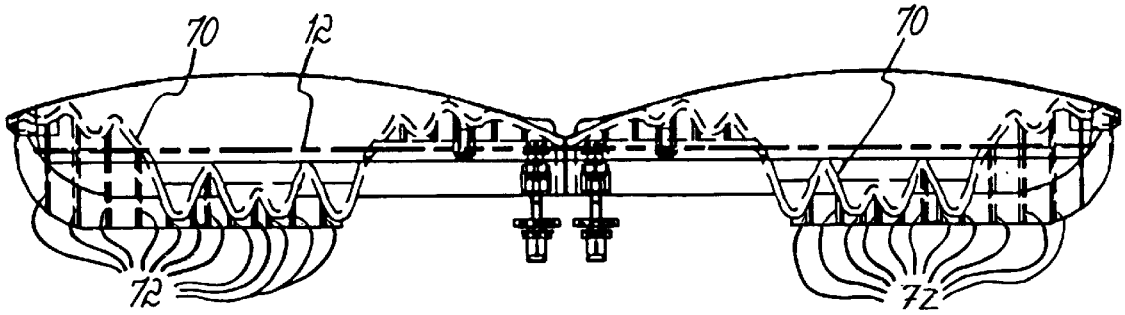
FIG. 7 is a sectional view of a vertically polarized 60 degree sector 10 GHz LMDS antenna with the radome removed in accordance with another embodiment of the present invention.

Referring now to FIG. 7, a sectional view of an embodiment of the present invention is illustrated for a vertically polarized 10 GHz LMDS antenna with an azimuth beam width of 60 degrees. In this illustration, the radome has been removed to further illustrate the reflector elements 70. As will be appreciated by one of ordinary skill in the art, the shape of the reflector elements 70 has been formed so as to provide a desired azimuth beamwidth of 60 degrees. In addition, structural support ribs 72 have been added to the reflector elements 70 to further stabilize the positioning of the reflector elements 70 relative to integrated feed system 12.

Figure 8:
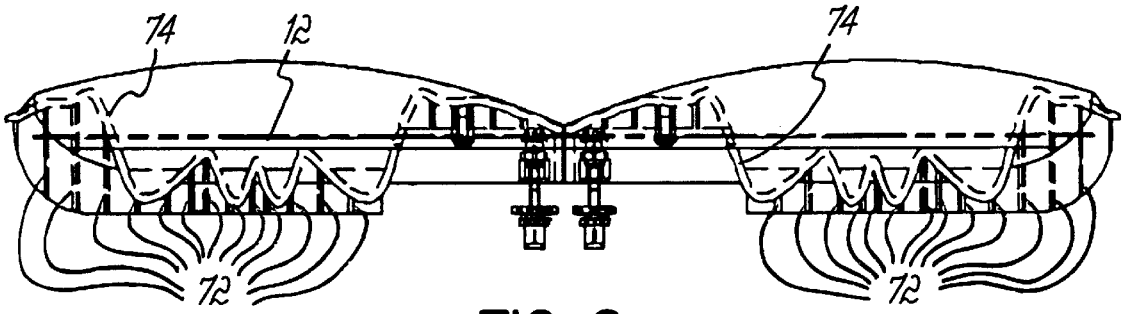
FIG. 8 is a sectional view of a vertically polarized 90 degree 10 GHz LMDS antenna with the radome removed in accordance with another embodiment of the present invention.

Referring now to FIG. 8, a sectional view of an embodiment of the present invention is illustrated for a vertically polarized 10 GHz LMDS antenna with an azimuth beam width of 90 degrees. In this illustration, as in FIG. 7, the radome has been removed to further illustrate the reflector elements 72. Similar to the embodiment of FIG. 7, the reflector elements 74 of the embodiment of FIG. 8 have been formed so as to provide a desired azimuth beamwidth of 90 degrees. Also like the reflector elements 70 of FIG. 7, the reflector elements 74 of FIG. 8 have structural support ribs 72.

Figure 9:
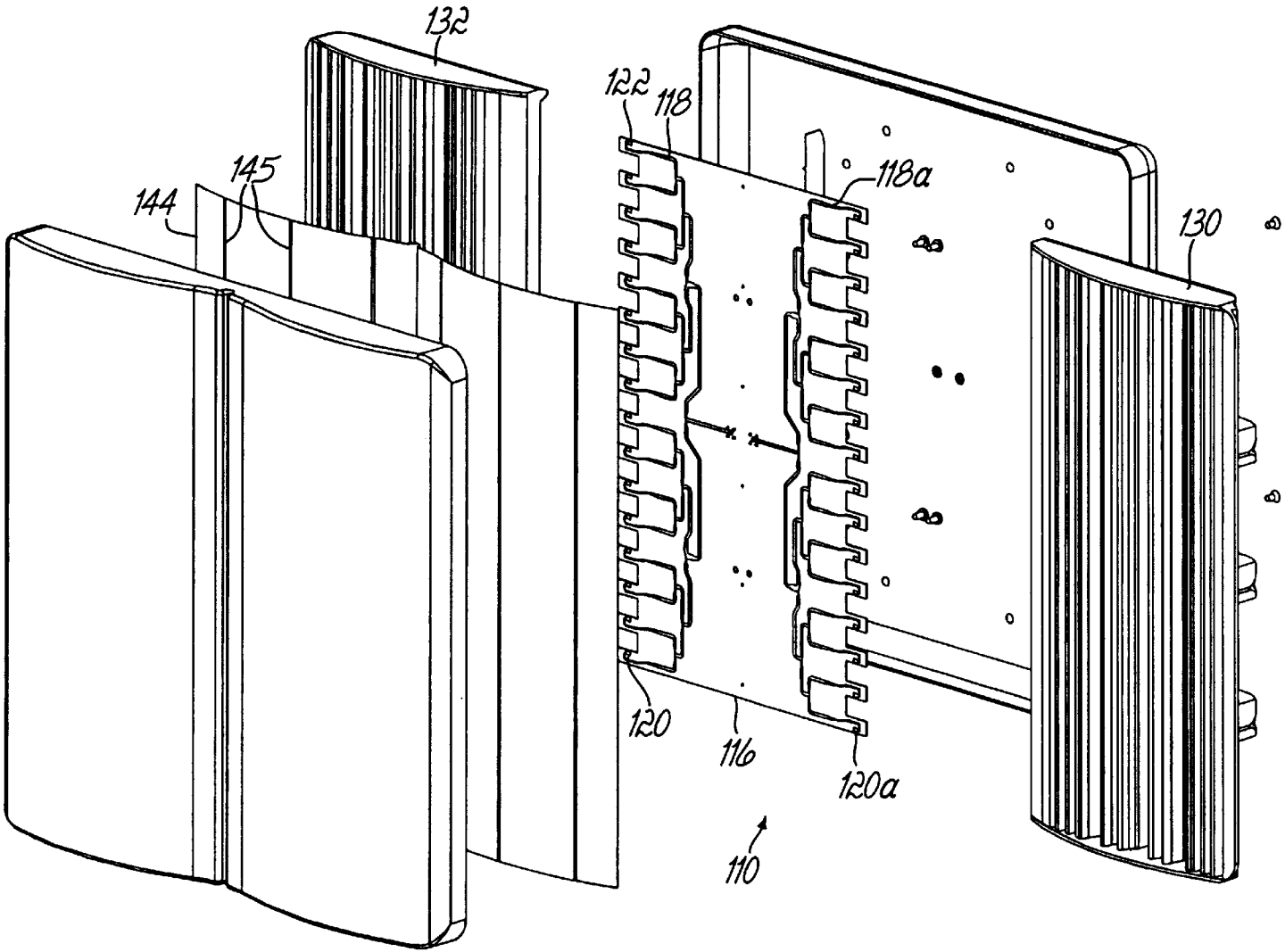
FIG. 9 is an exploded view of a horizontally polarized antenna in accordance with another embodiment of the present invention.
Figure 11:
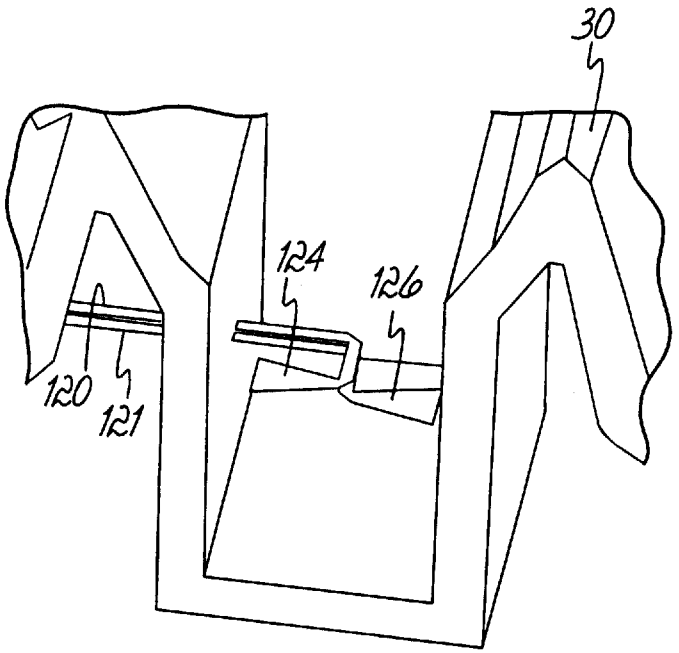
FIGS. 10 and 11 are enlarged partial views, showing bowtie dipole feed elements for a horizontally polarized antenna consistent with one embodiment of the invention.
Figure 10:
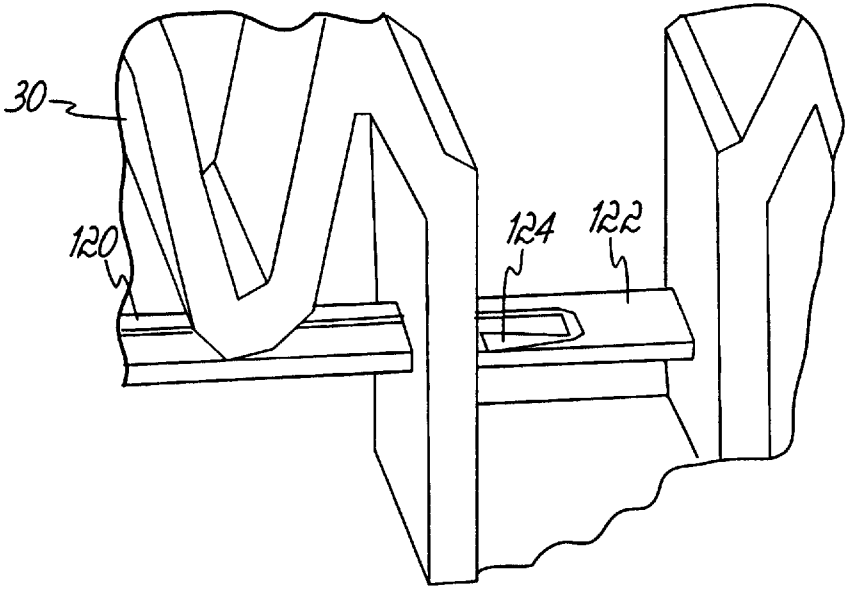

FIGS. 9–11 illustrate an alternative embodiment of the invention. FIG. 9 shows an exploded view of an antenna embodiment referenced above for a horizontally polarized 10 GHz LMDS antenna with an azimuth beamwidth of 90 degrees. Similar to the embodiment of FIG. 1, the antenna 110 in FIG. 9 employs an integrated feed system or network 112 with a feed network 118 electrically coupled to feed or radiating elements 120 located on fingers 122. Also, like the embodiment of FIG. 1, the radiating elements 120 are configured as dipole elements, and deposited on the front and back sides of the circuit board 116. However, the projecting fingers 122 are somewhat shorter in the embodiment of FIGS. 9–11. Further, the feed network 118 and elements 120 are duplicated on the other side of circuit board 116 as elements 118*a*, 120*a*. However, in comparison to the embodiment of FIG. 1, the radiating elements 120, 120*a* have been rotated 90 degrees and when used in conjunction with reflector elements 130, 132 provide an antenna 110 with horizontal polarization with an azimuth beamwidth of 90 degrees.

An optional polarizing sheet may be used. The polarizing sheet 144 for horizontally polarized embodiments of the present invention may consist of a mylar sheet, approximately 0.006 inches thick, with parallel etched copper strips or wires 145, approximately 0.015 inches wide, located approximately every 0.043 inches. The polarizing sheet 144 may be placed so that the strips 145 run vertically as shown in FIG. 9. The polarizing sheet 144 functions to filter the cross-polarized radiation from the antenna response, in effect, "cleaning up" the polarization. Although this polarized sheet 144 may be used for the embodiment of the invention shown in FIG. 9, variations in the polarizing sheet for other embodiments are possible without departing from the spirit of the invention.

More particularly, and as best illustrated in FIGS. 10 and 11, radiating elements 120 comprising "bowtie" dipoles are illustrated. The bowtie dipoles are formed on either side of the projecting fingers 122 of the circuit board 116. The bowtie dipole elements on the top surface of the finger 122 are indicated by reference numeral 124 in FIGS. 10 and 11. The bowtie dipole element on the bottom side of the finger 122 is not visible in FIG. 10; but is shown in FIG. 11, as the finger 122 has been removed to illustrate the bowtie elements 124, 126 and their respective feed lines 120, 121 formed on either side of the finger 122. Other embodiments of the present invention may use simple straight dipole elements without departing from the spirit of the invention.

Figure 12:
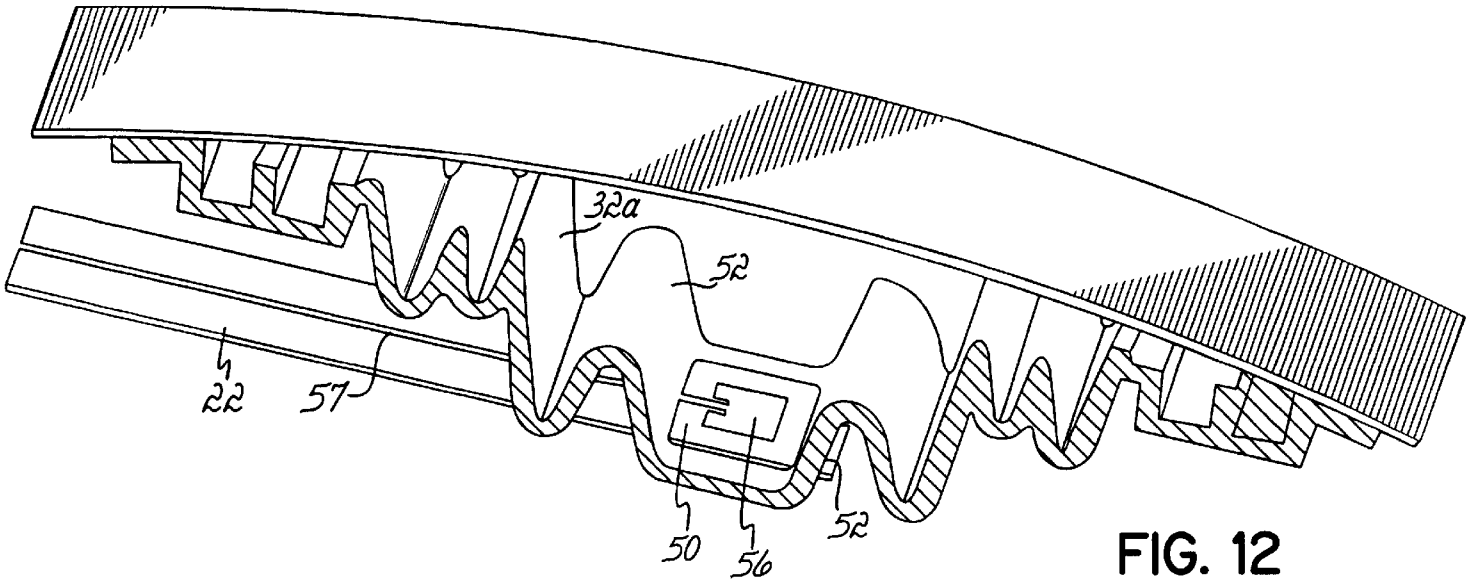
FIG. 12 is a simplified partial perspective view through a shaped reflector element and feed network for a horizontally polarized antenna having microstrip patch feed elements in accordance with one embodiment of the present invention.
Figure 13:
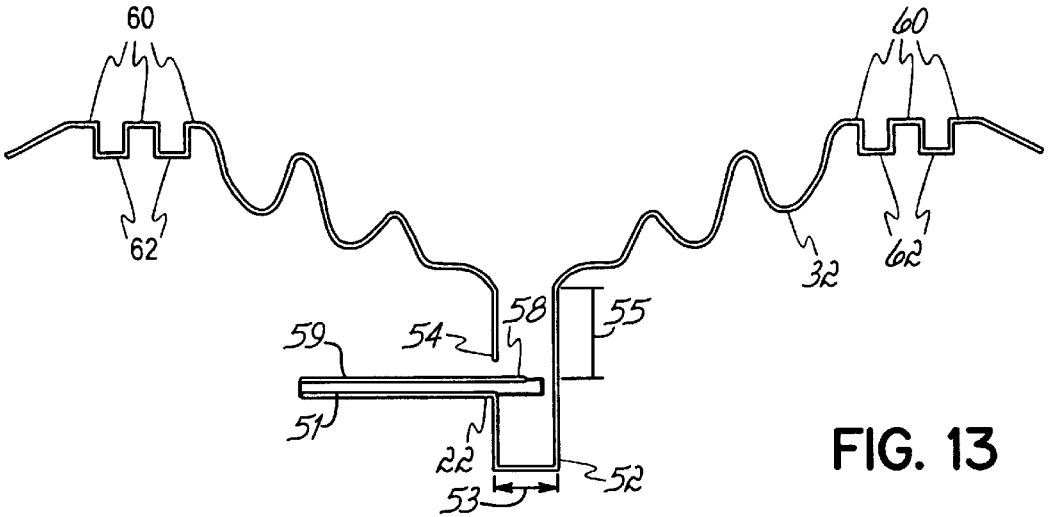
FIG. 13 is a simplified, sectional view of a shaped reflector element and feed network for a horizontally polarized antenna in accordance with one embodiment of the present invention.

Referring now to the embodiments shown in FIGS. 12 and 13, and as alluded to, another aspect of the invention involves alternative radiating elements. In the embodiment of FIG. 12, patches elements 56 etched on a circuit board 50 located in the bottom of a trough waveguide 52 are employed. As illustrated, microstrip patch elements 56 are fed by microstrip transmission lines 57 that are mounted or formed on fingers 22, and fitted as feed elements in a trough waveguide 52 formed in the surface of the shaped reflector panel 32*a*. As also illustrated in FIG. 12, the trough waveguide 52 does not have a constant width, but remains narrow enough to inhibit propagation of higher order modes.

Referring now to FIG. 13, probe-feed radiating elements 58 are employed. In FIG. 13, probe-feed radiating elements 58 are formed in the end of a microstrip feed line 59. The straight microstrip line is formed on the surface of fingers 22 that extends through openings 54 in the side of the waveguide 52 formed in the surface of the shaped reflector panel 32. As illustrated for this particular embodiment, the microstrip feed line is formed on the top surface of fingers 22. Also formed on the fingers 22 is a ground plane 51. This embodiment requires either direct ground plane 51 to metallized reflector 32 contact, or capacitive coupling at the point where the ground plane 51 enters the trough waveguide 52. As shown in this particular embodiment, the ground plane 51 is formed on the bottom surface of the fingers 22. However, a microstrip feed line could be formed on the bottom and a ground plane formed on the top without departing from the scope of the invention. In such a scenario, the fingers 22 would be shifted upwardly to maintain the aforementioned ground contact or coupling. Unlike the embodiment shown in FIG. 12, the trough waveguide 52 of the embodiment of FIG. 13 has walls that remain at a constant width selected to prevent propagation of higher order modes.

The reflector element 32, as viewed in cross-section, is curvilinear, i.e., with a smoothly, continuously curved or "wavy" form. Asymmetry in the radiated fields excites an evanescent higher order trough waveguide mode that is attenuated by the distance or depth 55. This depth 55 from the open end of the trough waveguide 52 to the radiating element 56 may be adjusted to obtain symmetric azimuth sector patterns; for 10 GHz, one embodiment sets this depth 55 at 0.319 inches. The trough waveguide 52 should be conveniently sized to transmit only the lowest mode effectively. For applications in the 10 GHz LMDS band, the width 53 has been found to be approximately 1.29 centimeters. While this is shown for a probe element 58 of FIG. 13, the aforementioned is also valid for the bowtie dipole elements in FIGS. 10–11 and for patch elements used in the embodiment of FIG. 12.

The small through openings 54 are formed at regular intervals along the length of the trough waveguide 52 formed in the reflector 32 to accommodate the fingers 22 carrying the probes 58, that may be the same in number and have the same relative spacing as the fingers 22 bearing the dipole elements shown in FIG. 1, for example. The patches 56 may be similarly formed in the bottom of the trough waveguide 52 on the same circuit boards 16, 116 on the outwardly projecting fingers 22, 122 thereof, as were illustrated in previous embodiments. Thus, the microstrip probe/patch array is used to excite the trough waveguide 52 of the reflectors 32, 32*a*.

As illustrated in the horizontally polarized embodiments disclosed herein, chokes may be utilized, such as edge chokes formed by alternating ribs 60, and grooves 62 to provide additional control of the radiation pattern. Edge chokes function to prevent or "choke off" electric currents on the reflector edges from wrapping around to the back sides of the reflector and degrading the radiation pattern with unpredictable reactions.

Figure 14:
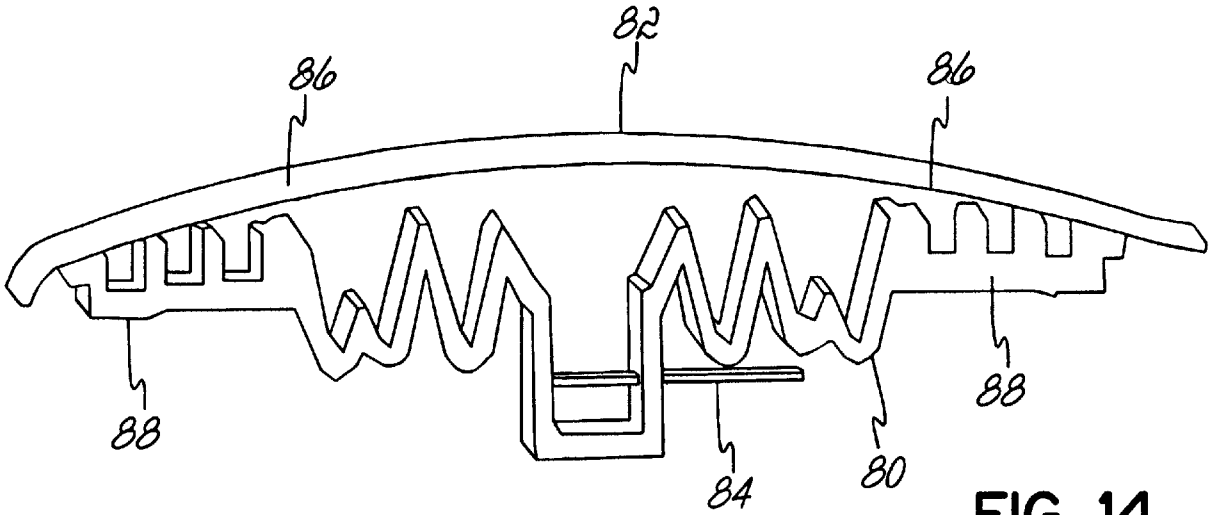
FIG. 14 is a simplified, partial perspective view of reflector and feed elements for a horizontally polarized 90 degree 10 GHz LMDS antenna in accordance with another embodiment of the present invention.

Referring now to FIG. 14, a simplified, partial perspective view of a reflector element 80 and feed elements 84, such as bowtie dipole elements 124, 126 shown in the embodiment of FIGS. 10 and 11, for a horizontally polarized 90 degree 10 GHz LMDS antenna in accordance with another embodiment of the present invention is illustrated. In this embodiment the reflector elements 80 have been shaped to provide a desired azimuth beamwidth of 90 degrees housed within radome 82. Also, as illustrated in FIG. 14, edge chokes in the form of alternating ribs 86 and grooves 88, have been included to provide additional radiation pattern control.

Figure 15:
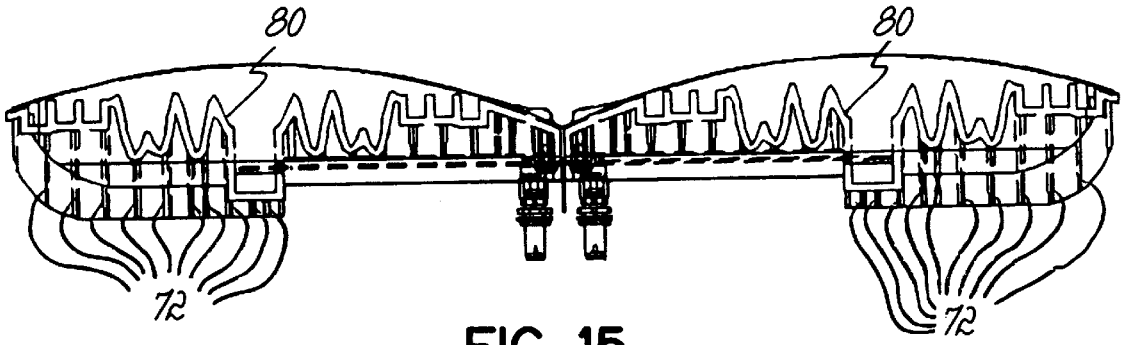
FIG. 15 is a sectional view of a horizontally polarized 90 degree sector azimuth 10 GHz LMDS antenna with the radome removed in accordance with another embodiment of the present invention.

Referring now to FIG. 15, a sectional view of the embodiment of FIG. 14 is illustrated for the horizontally polarized 10 GHz LMDS antenna with an azimuth beamwidth of 90 degrees. In this illustration, the radome has been removed to further illustrate the reflector elements 80. As will be appreciated by one of ordinary skill in the art, the shape of the reflector elements 80 has been formed so as to provide a desired azimuth beamwidth of 90 degrees. In addition, structural support ribs 72 have been added to the reflector elements 80 to further stabilize the positioning of the reflector elements 80 relative to the feed elements 84.

Figure 16:
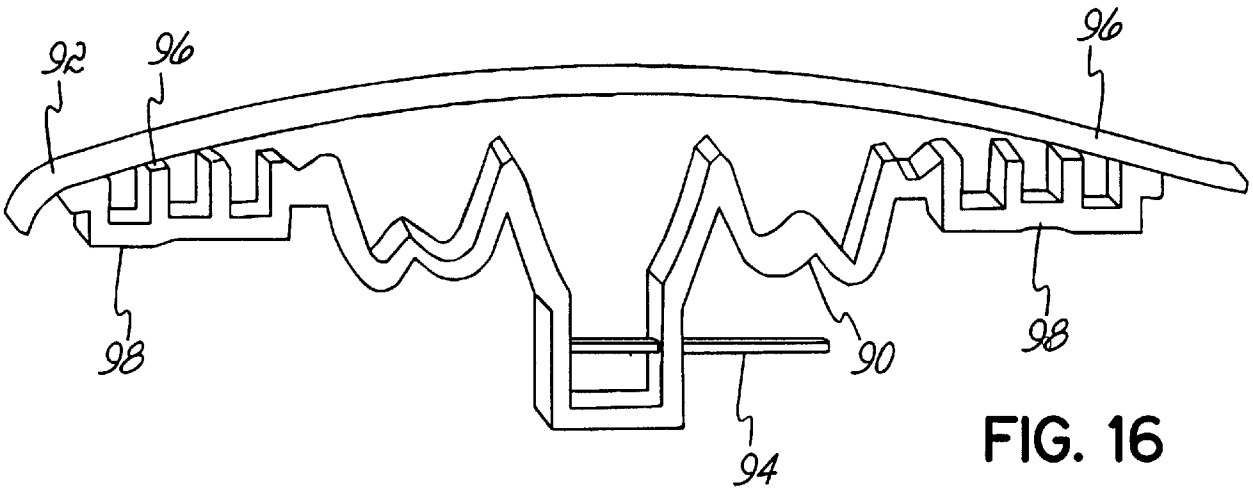
FIG. 16 is a simplified, partial perspective view of reflector and feed elements for a horizontally polarized 60 degree sector azimuth 10 GHz LMDS antenna in accordance with another embodiment of the present invention.

Similar to the embodiment of FIGS. 14 and 15, the embodiment of the present invention shown in FIG. 16 is for a horizontally polarized 60 degree 10 GHz LMDS antenna. A simplified, partial perspective view of a reflector element 90 and feed elements 94, such as patch elements 56 shown in the embodiment of FIGS. 12 and 13, within radome 92 is illustrated. Also, as an alternative aspect of the present invention, edge chokes in the form of alternating ribs 96 and grooves 98, have been include to provide additional radiation pattern control.

Figure 17:
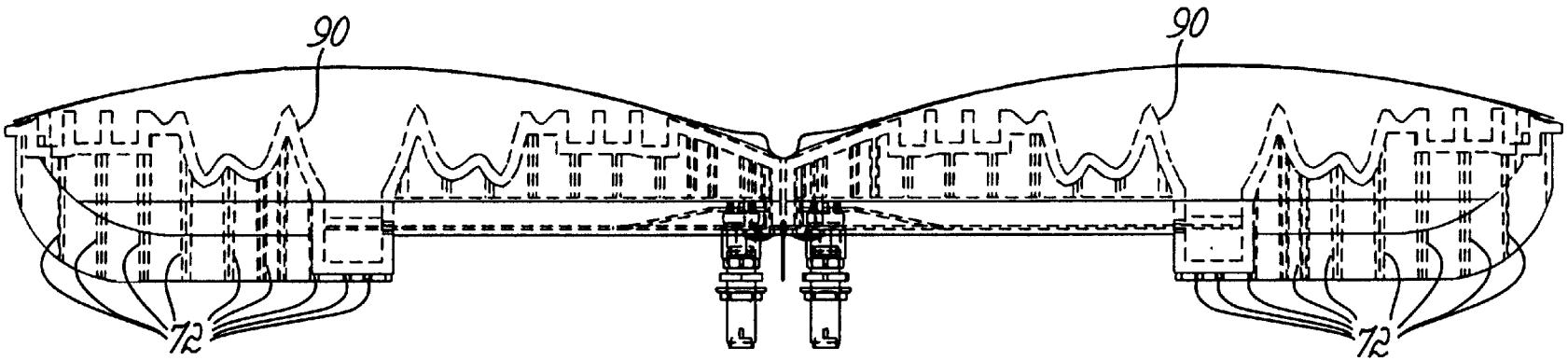
FIG. 17 is a sectional view of a horizontally polarized 60 degree sector azimuth 10 GHz LMDS antenna with the radome removed in accordance with another embodiment of the present invention.

Referring now to FIG. 17, a sectional view of the embodiment of FIG. 16 is illustrated. In this illustration, as in FIG. 15, the radome has been removed to further illustrate the reflector elements 90. Also similar to the embodiment of FIGS. 14 and 15, the reflector elements 90 have been formed so as to provide a desired azimuth beamwidth of 60 degrees. Once again, structural support ribs 72 have been provided.

Therefore, it may be seen that the invention outlined herein is useful from several viewpoints. It provides an improved antenna with a specified azimuth beamwidth. It has relatively simple and few parts. It is also relatively easy and inexpensive to manufacture. It is also easy to install and maintain. Thus, it achieves high performance in an aesthetically pleasing package.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed:

1. An integrated feed system for an antenna comprising:

a circuit board;

a first feed network formed on the circuit board; and a plurality of feed elements formed on the circuit board and electrically coupled with the first feed network and projecting outwardly therefrom, the board having a plurality of projecting fingers which mount the feed elements.

2. The feed system of claim 1, wherein the first feed network comprises a microstrip network.

3. The feed system of claim 1, wherein the feed elements are dipole elements.

4. The feed system of claim 3, wherein a microstrip feed network and dipole elements are formed on opposite surfaces of the circuit board.

5. The feed system of claim 3, wherein the dipole elements are configured for vertical polarization.

6. The feed system of claim 3, wherein the dipole elements are configured for horizontal polarization.

7. The feed system of claim 1, wherein the feed elements are microstrip patch elements.

8. The feed system of claim 1 wherein a second feed network is formed on the circuit board, and one or more second feed elements project from the second feed network in a direction opposite the feed elements projecting from the first feed network.

9. The feed system of claim 8, wherein the second feed network comprises a microstrip network.

10. The feed system of claim 8, wherein the second feed elements are dipole elements.

11. The feed system of claim 8, wherein the second feed elements are microstrip patch elements.

12. An antenna comprising:

a shaped reflector element; and a feed system comprising:

a circuit board, a feed network formed on the circuit board; and, a plurality of feed elements electrically coupled with the feed network and projecting outwardly therefrom, the board having projecting fingers which mount the feed elements, the fingers being positioned for suspending the feed elements above the reflector element.

13. The antenna of claim 12, wherein the reflector element includes at least one slot formed therein, a finger projecting through the slot for suspending the feed element.

14. The antenna of claim 12, wherein the feed network comprises a microstrip network.

15. The antenna of claim 12, wherein the feed elements are dipole elements.

16. The antenna of claim 12, wherein the feed element s are microstrip patch elements.

17. The antenna of claim 15, wherein a microstrip feed network and the dipole elements are formed on opposite sides of the circuit board.

18. The antenna of claim 15, wherein the dipole elements are configured for vertical polarization.

19. The antenna of claim 15 wherein the dipole elements are configured for horizontal polarization.

20. The antenna of claim 12, wherein a second feed network is also formed on the circuit board and one or more second feed elements project from the second feed network in a direction opposite the feed elements projecting from the first feed network.

21. The antenna of claim 20, wherein the second feed elements are dipole elements.

22. The antenna of claim 12, wherein the reflector element comprises a curvilinear shaped surface having a smoothly curved cross-section.

23. The antenna of claim 12, wherein the reflector element includes a trough waveguide having at least one slot formed therein for receiving a finger therethrough.

24. The antenna of claim 12, wherein the reflector element has a plurality of chokes formed on an outer edge thereof.

25. The antenna of claim 12, further comprising:

a second reflector element; and, the feed system further comprising:

a second feed network formed on the circuit board; and, a second plurality of feed elements electrically coupled with the second feed network and projecting outwardly therefrom, the board having projecting fingers which mount the second feed elements; and, the second feed element fingers being positioned for suspending the second feed elements above the second reflector element; and, the first and second reflector elements having slots formed therein, the fingers projecting therethrough for suspending the feed elements.

26. The antenna of claim 25, wherein the first and second reflector elements each comprise a curvilinear shaped surface.

27. The antenna of claim 26, wherein the first and second reflector elements each include a trough waveguide.

28. The antenna of claim 27, wherein the second plurality of feed elements are dipole elements.

29. The antenna system of claim 25 wherein the first plurality of feed elements is configured for one of vertical and horizontal polarization and the second plurality of feed elements is configured for the other of vertical and horizontal polarization.

30. The antenna of claim 27, wherein each reflector element has a plurality of chokes formed on outer edges thereof.

31. An integrated feed method for an antenna comprising:

with a feed network formed on the circuit board, feeding a plurality of feed elements also formed on the circuit board; and, positioning the feed elements on a plurality of fingers projecting outwardly from an edge of the circuit board.

32. The method of claim 31 further comprising reflecting signals from the feed elements with a reflector element and suspending the feed elements over the reflector element.

33. The method of claim 32 further comprising projecting the fingers carrying the feed elements through slots formed in the reflector element to suspend the feed elements over the reflector element.

34. The method of claim 32, wherein the reflector element surface comprises a curvilinear surface.

35. The method of claim 32, wherein the reflector element includes a trough waveguide, the method further comprising suspending the feed elements in the trough.

36. The method of claim 32, wherein the reflector element includes a plurality of chokes on an outer edge thereof.

37. The method of claim 31, wherein the feed network is a microstrip feed network.

38. The method of claim 31 wherein the feed elements are dipole elements.

39. The method of claim 38, wherein the dipole elements are configured for horizontal polarization.

40. The method of claim 38, wherein the dipole elements are configured for vertical polarization.

41. The method of claim 31, wherein the feed elements are microstrip patch elements.

42. The method of claim 32, further comprising:

feeding a second plurality of feed elements formed on the circuit board with a second feed network formed on the circuit board, positioning the second plurality of feed elements on a plurality of fingers projecting in a direction opposite to the fingers carrying the first feed elements.

43. The method of claim 42, wherein the second plurality of feed elements are dipole elements.

44. The method of claim 42, wherein the second plurality of feed elements are microstrip patch elements.

45. The method of claim 42 further comprising configuring the first plurality of feed elements for one of vertical polarization and horizontal polarization and configuring the second plurality of feed elements for the other of vertical polarization and horizontal polarization.

46. The method of claim 42 further comprising reflecting signals from the second plurality of feed elements with a second reflector element and suspending the second plurality of feed elements over the reflector element.

47. The method of claim 46 further comprising projecting the fingers carrying the second feed elements through slots formed in the second reflector element.

48. The method of claim 46, wherein at least one of the reflector elements includes a plurality of chokes on an outer edge thereof.

49. The method of claim 31, wherein the feed network and the feed elements are formed on opposite sides of the circuit board.

* * * * *